US007886406B2

(12) United States Patent
Chang

(10) Patent No.: US 7,886,406 B2
(45) Date of Patent: Feb. 15, 2011

(54) HINGE DEVICE HAVING TWO BACK-TO-BACK INTERCONNECTED C-SHAPED CLAMPS

(76) Inventor: Chao-Ming Chang, No. 474 Yijiao St., Chiayi City (TW)

( * ) Notice: Subject to any disclaimer, the term of this patent is extended or adjusted under 35 U.S.C. 154(b) by 140 days.

(21) Appl. No.: 12/357,795

(22) Filed: Jan. 22, 2009

(65) Prior Publication Data

US 2010/0180404 A1 Jul. 22, 2010

(51) Int. Cl.
*E05D 5/02* (2006.01)

(52) U.S. Cl. ..... 16/252; 24/339; 248/316.7; 403/385

(58) Field of Classification Search ..... 16/252, 16/253, 387; 24/335–339, 488, 545, 563; 248/74.2, 316.7; 403/385, 309, 344, 373, 403/289; 52/80.1; 285/419, 420, 236
See application file for complete search history.

(56) References Cited

U.S. PATENT DOCUMENTS 3,033,412 A * 5/1962 Fox ..... 220/23.4
4,115,966 A * 9/1978 DeLee ..... 52/148
4,821,382 A * 4/1989 Puschkarski ..... 24/298
D440,005 S * 4/2001 Blanton ..... D26/138
6,298,525 B1 * 10/2001 Margo ..... 24/336
6,412,232 B1 * 7/2002 Provitola ..... 52/80.1
D480,970 S * 10/2003 Owens ..... D9/456
7,478,641 B2 * 1/2009 Rousselet ..... 132/318
D590,910 S * 4/2009 Mullins ..... D22/134
7,712,635 B2 * 5/2010 Kovac ..... 222/327

* cited by examiner

*Primary Examiner*—William L. Miller
(74) *Attorney, Agent, or Firm*—Kilpatrick Townsend & Stockton LLP

(57) ABSTRACT

A hinge device includes a coupler having two substantially C-shaped outer clamp members which are interconnected back-to-back at a juncture and which respectively have open mouths opposite to the juncture, and two substantially cylindrical inner clamp members fitted rotatably and respectively in the outer clamp members. Each inner clamp member has a substantially cylindrical outer surface, and two clamping arms defining an axially extending clamping groove therebetween. The clamping groove has a groove opening alignable with the open mouth of one of the outer clamp members. A hoop assembly having two hoops interconnected hingedly by the hinge device is also disclosed.

6 Claims, 6 Drawing Sheets

HINGE DEVICE HAVING TWO BACK-TO-BACK INTERCONNECTED C-SHAPED CLAMPS

BACKGROUND OF THE INVENTION

1. Field of the Invention

This invention relates to a hinge device, more particularly to a hinge device of the type having two substantially C-shaped clamp members which are back-to-back interconnected.

2. Description of the Related Art

Referring to FIGS. 1 and 2, there is shown a hoop assembly usable as a game apparatus for children and having hinge devices 11 each of which interconnects two hoops 12. Typically, the hoops 12 are of circular cross-section, and each hinge device 11 has two substantially C-shaped clamp members 110 to clamp rotatably and respectively two hoops 12 so that the hoops 12 are hingedly interconnected and are pivotal relative to each other to change in angle formed therebetween. In use, a plurality of the hoops 12 are assembled in series using a number of the hinge devices 11, and the hoops 12 are set upright to provide a multiplicity of passages for children to thread therethrough.

However, inconveniences are encountered during use of the game device because the hoops 12 are easily separable from the hinge devices 11 when hit by children and have to be reassembled frequently during use. Besides, as the hoops 12 are circular in cross section, a substantial height will be built up when multiple hoops 12 are stacked, thereby requiring a large space for storage and transport. If the hoops 12 are to be provided with flat cross sections in order to save space, the hinge devices 11 will be unsuitable for interconnecting the hoops 12.

SUMMARY OF THE INVENTION

An object of the invention is to provide a novel hinge device by which two hoops can be firmly hinged together, thereby reducing an incidence of undesirable or accidental hoop separation.

Another object of the invention is to provide a novel hinge device which is suitable to hinge two hoops having a noncircular cross section that is substantially flat.

According to one aspect of the present invention, a hinge device comprises: a coupler including two substantially C-shaped outer clamp members which are interconnected back-to-back at a juncture and which respectively have open mouths opposite to the juncture; and two substantially cylindrical inner clamp members fitted rotatably and respectively in the outer clamp members. Each inner clamp member has a substantially cylindrical outer surface, and two clamping arms defining an axially extending clamping groove therebetween. The clamping groove has a groove opening alignable with the open mouth of one of the outer clamp members.

According to another aspect of the present invention, a hoop assembly comprises at least two hoops interconnected hingedly by the hinge device. Each of the hoops has a noncircular cross section that is substantially flat. Each of the hoops further has an annular inner rim, an annular outer rim surrounding the inner rim, and an annular intermediate section connected between the inner and outer rims. The inner and outer rims are thicker than the intermediate section.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENTS

Figure 1:
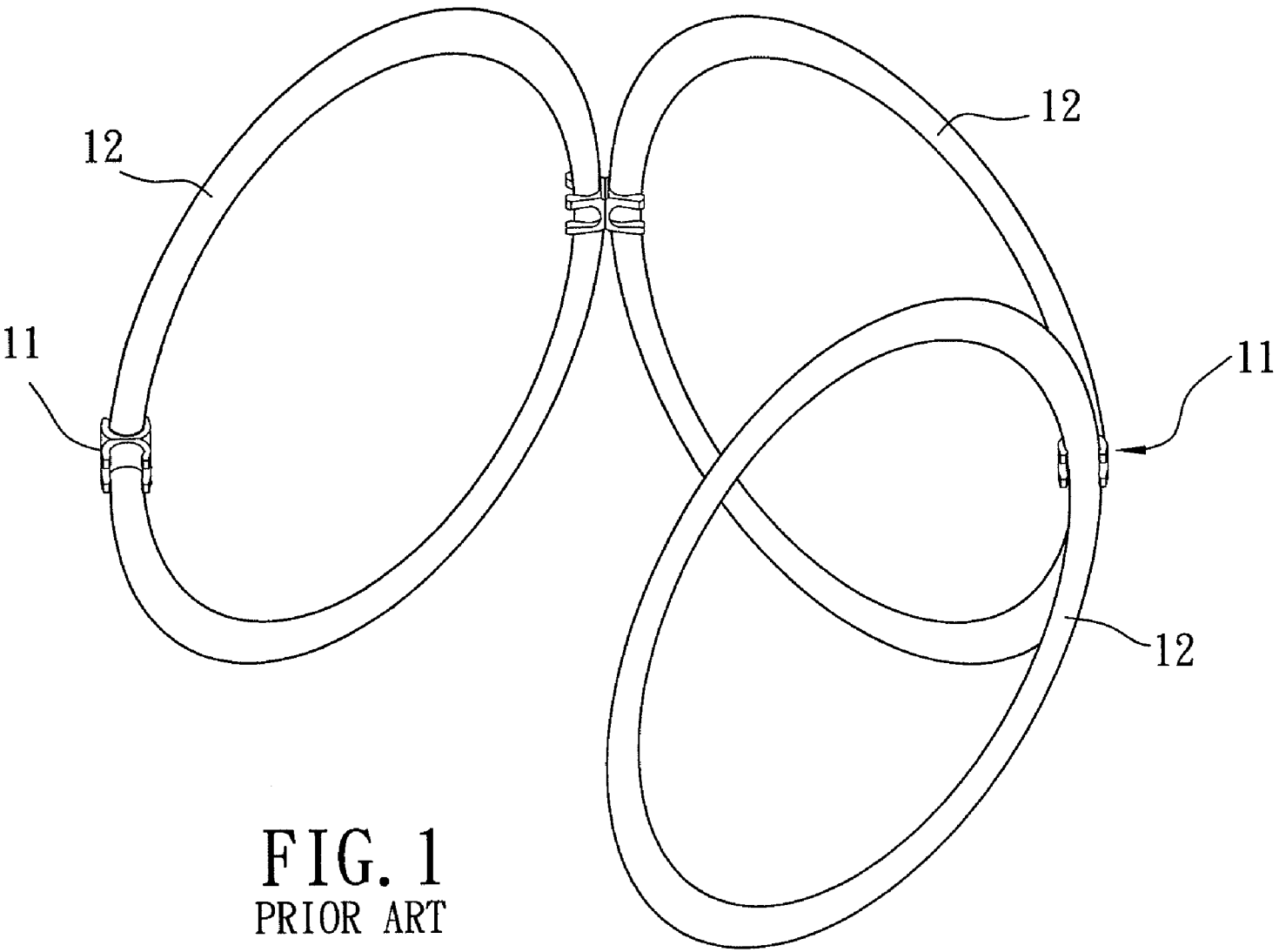
FIG. 1 PRIOR ART
FIG. 1 is a perspective view of a conventional hoop assembly.
Figure 2:
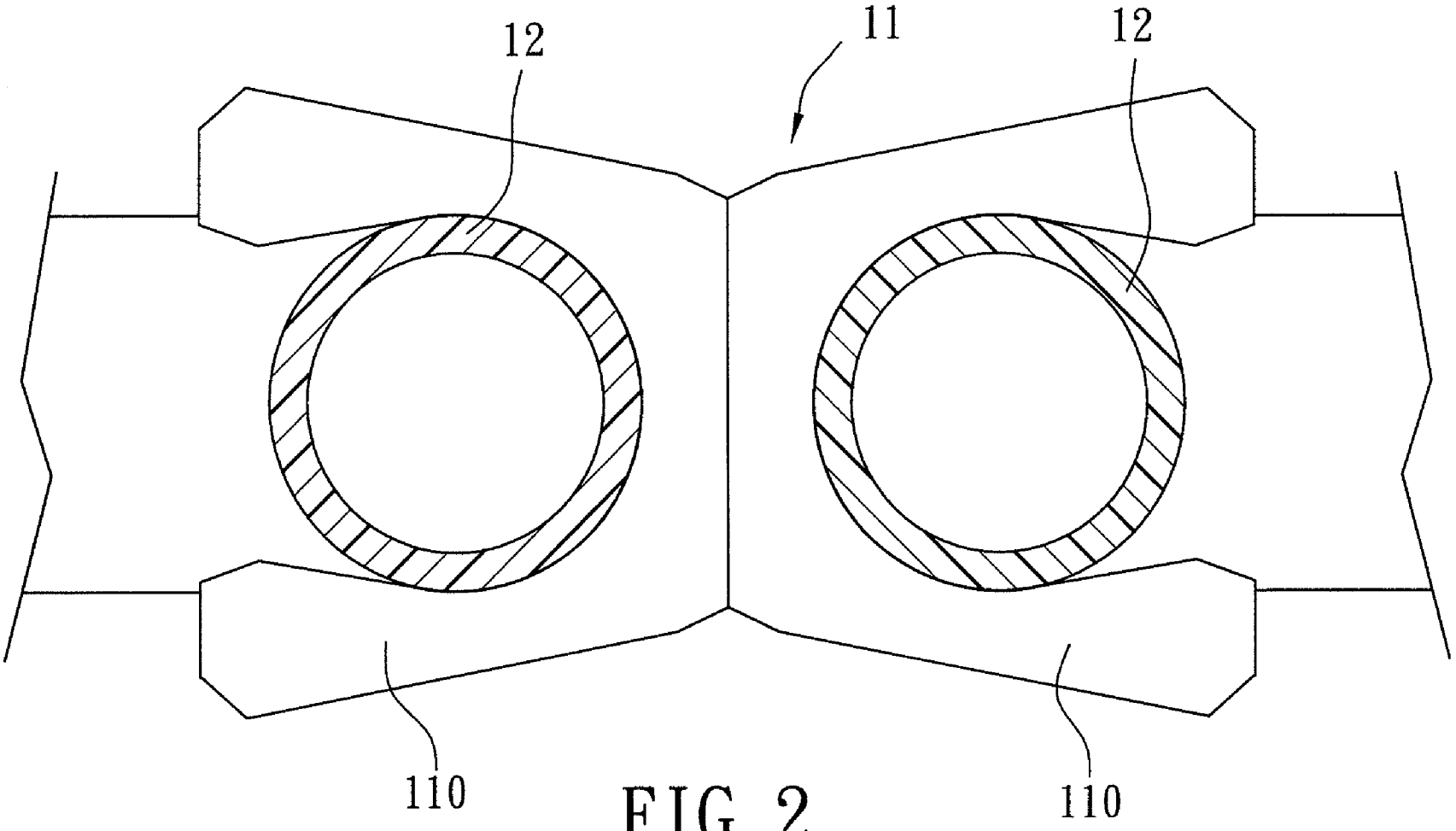
FIG. 2 PRIOR ART
FIG. 2 is a partially sectioned view of the conventional hoop assembly.
Figure 3:
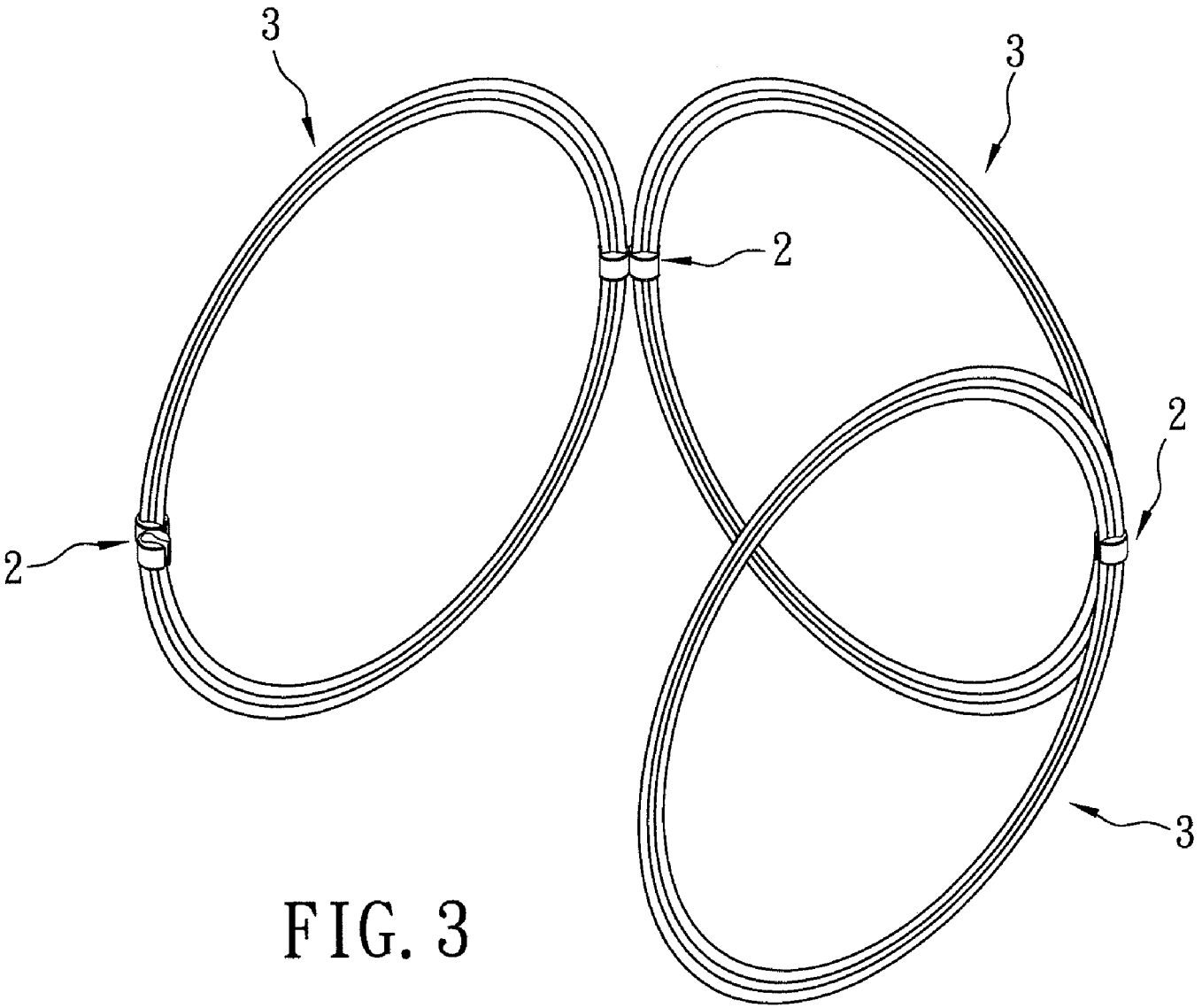
FIG. 3 is a perspective view of a hoop assembly according to the present invention.
Figure 4:
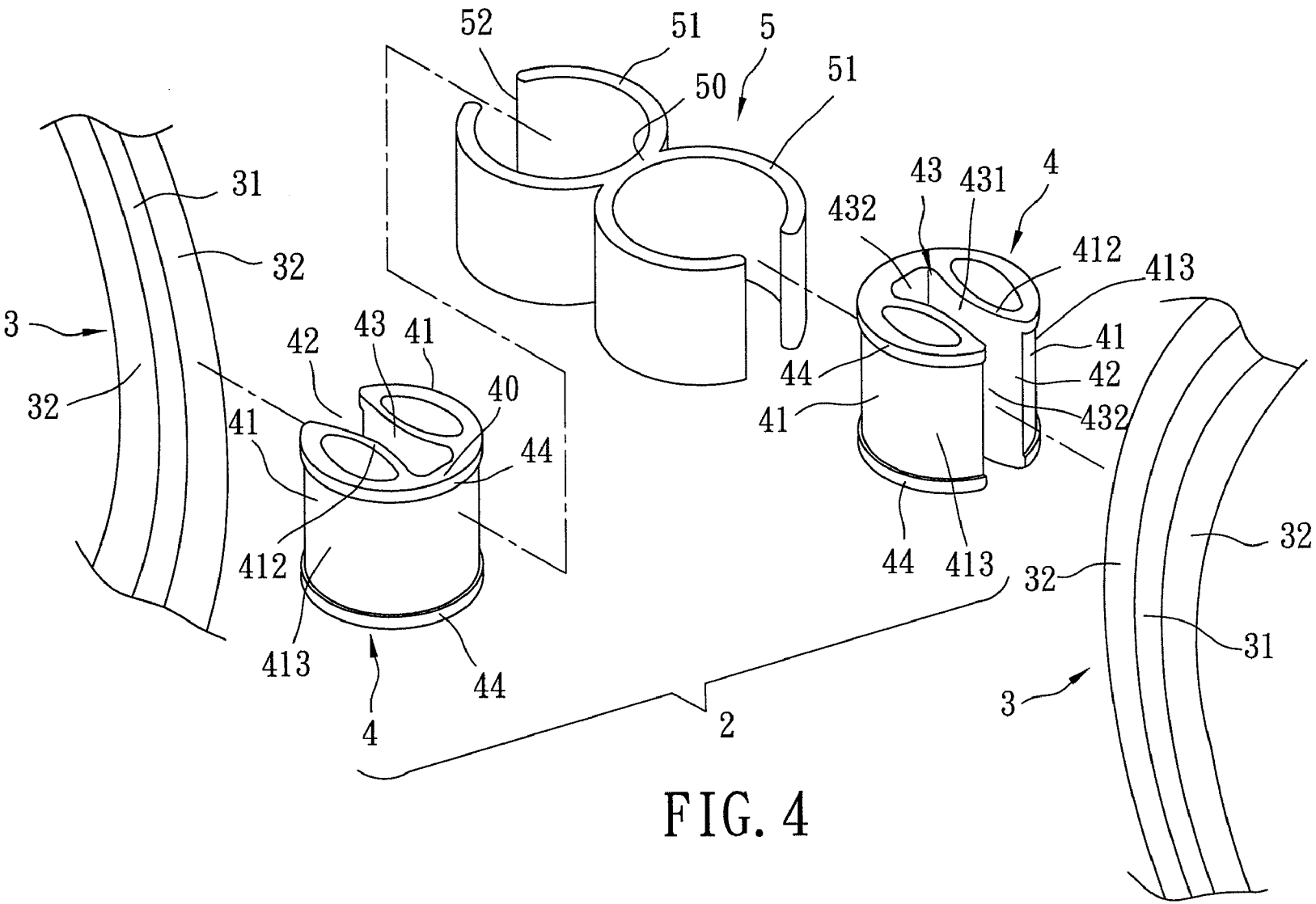
FIG. 4 is an exploded view of a hinge device according to the present invention.
Figure 5:
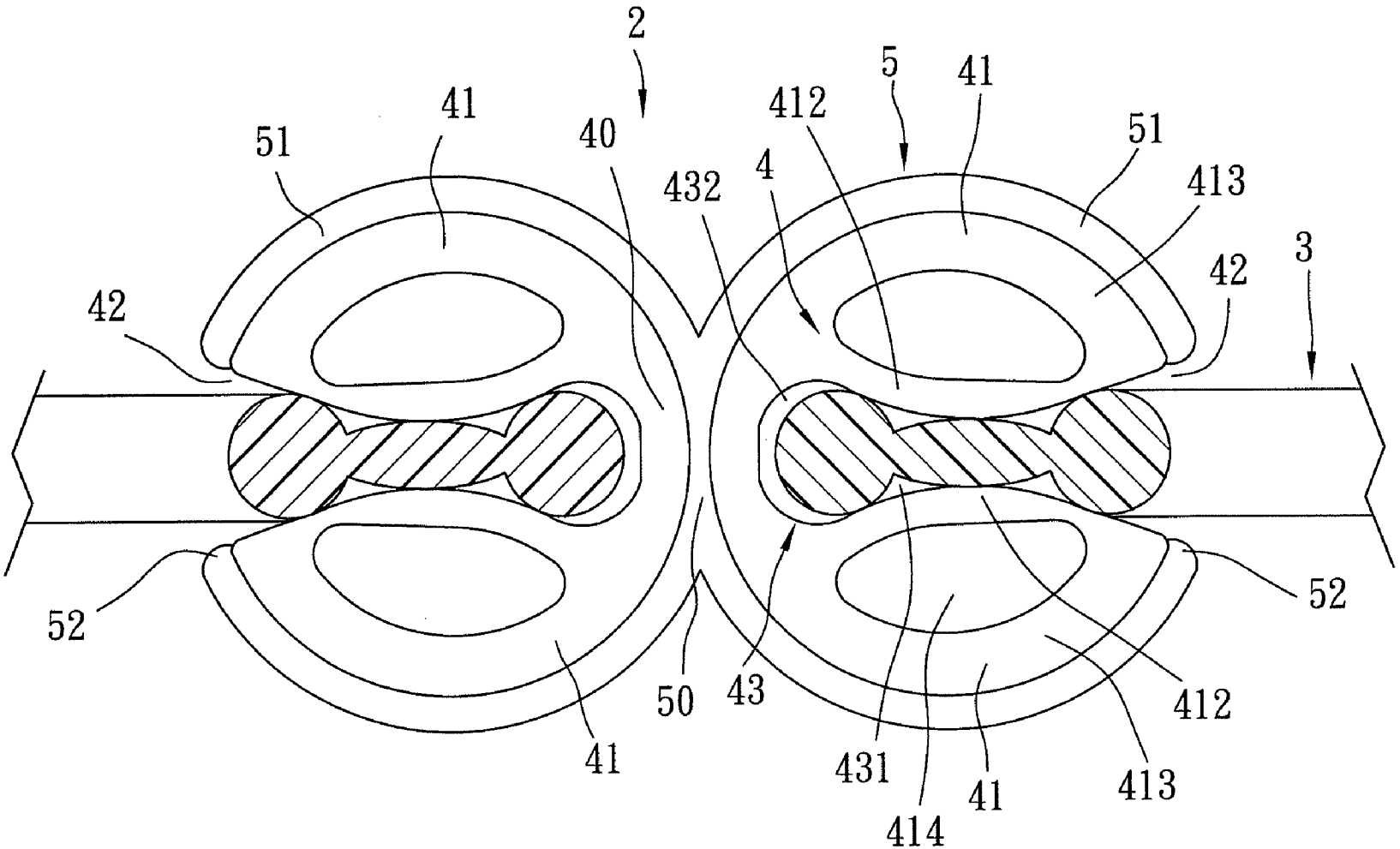
FIG. 5 is a partially sectioned view illustrating two hoops which are clamped by two respective inner clamp members of the hinge device.

Referring to FIG. 3, a hoop assembly according to the present invention includes a plurality of hoops 3 and hinge devices 2. Referring to FIGS. 4 and 5, each hoop 3 is substantially flat in cross section, and has annular outer and inner rims 32, and an annular intermediate section 31 connected between the outer and inner annular rims 32. The outer and inner rims 32 are thicker than the intermediate section 31.

Each hinge device 2 includes two substantially cylindrical inner clamp members 4, and a coupler 5. The coupler 5 has two substantially C-shaped outer clamp members 51 which are interconnected back-to-back at a juncture 50 and which respectively have open mouths 52 opposite to the juncture 50. In an embodiment, the outer clamp members 51 are formed integrally as one piece.

The inner clamp members 4 are fitted respectively in the outer clamp members 51. Each inner clamp member 4 has a substantially cylindrical outer surface in contact with the corresponding outer clamp member 51, two clamping arms 41 defining an axially extending clamping groove 43 therebetween, and a connection web 40 connected between the clamping arms 41. The cylindrical outer surface of the inner clamp member 4 extends circumferentially around the clamping arms 41 and the connection web 40.

The clamping groove 43 has two diametrically opposite groove end sections 432, a middle groove section 431 between the groove end sections 432, and a groove opening 42 adjacent to one of the groove end sections 432 and opposite to the connection web 40. The groove opening 42 is alignable with the open mouth 52 of the corresponding outer clamp member 51. The clamping groove 43 has a width that decreases gradually from the groove end sections 432 to the middle groove section 431. Each inner clamp member 4 further has two axially opposite flanges 44 protruding circumferentially and outwardly from the cylindrical outer surface thereof for retaining therebetween the corresponding outer clamp member 51 which is disposed over the cylindrical outer surface thereof.

Each clamping arm 41 has an outer wall 413 extending circumferentially from the connection web 40 to the groove opening 42 along the cylindrical outer surface, a compressible inner wall 412 bounding the clamping groove 43 and opposite to the outer wall 413, and a hollow space 414 between the outer and inner walls 413, 412. The inner wall 412 is convexed toward the clamping groove 43 and has two ends one of which is connected to the outer wall 413 adjacent the connection web 40 and the other one of which is connected to the outer wall adjacent the groove opening 42. Due to the presence of the hollow space 414, the inner wall 412 is compressible.

In assembly, the two hoops 3 are coupled together by one hinge device 2. The hoops 3 are inserted into the clamping grooves 43 of the respective inner clamp members 4 through the respective groove openings 42 and are clamped by the clamping arms 41 of the respective inner clamp member 4, as best shown in FIG. 5.

Figure 6:
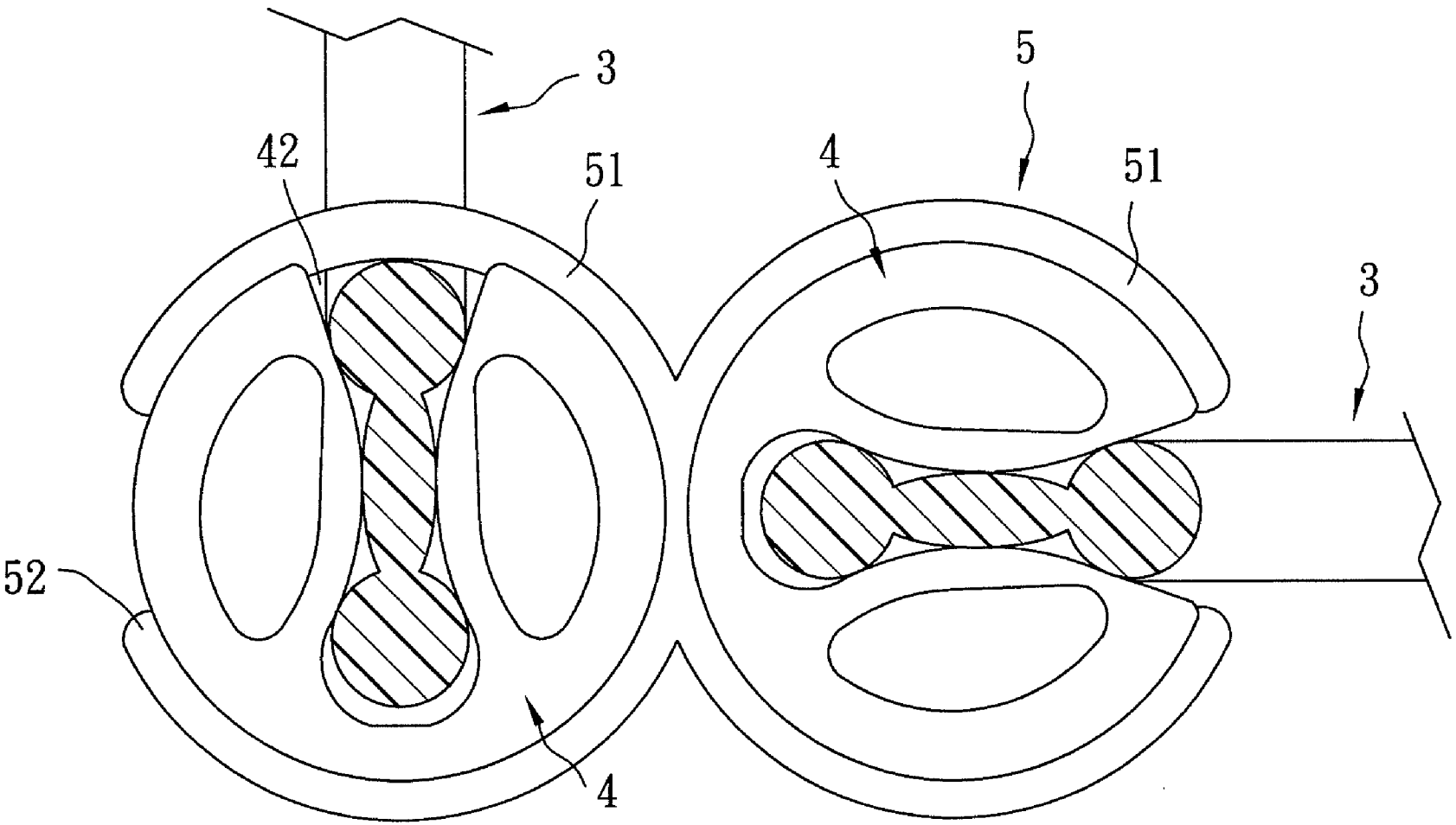
FIG. 6 is the same view as FIG. 5 but showing that the two hoops are angled to each other.

The inner clamp members 4 are rotatable within the respective outer clamp members 51 for adjusting the relative angle between the hoops 3. Referring to FIG. 6, when one of the two hoops 3 is turned relative to the other hoop 3, the corresponding inner clamp member 4 is rotated within the corresponding outer clamp member 51 so that the groove opening 42 thereof is moved away from the open mouth 52 of the outer clamp member 51.

As the groove opening 42 is out of alignment with the open mouth 52, the hoop 3 can be effectively prevented from being released from the inner clamp member 4 even when the hoop 3 is subjected to a hitting force. This is one of the advantages of the hinge device 2 of the present invention. Another advantage is that the hinge device 2 can effectively clamp the hoops 3 which are substantially flat in cross section. When the hoops 3 are stacked, the overall side thereof can be minimized compared to the prior art, thereby reducing the space needed for storage and transport of the hoops.

While the present invention has been described in connection with what are considered the most practical and preferred embodiments, it is understood that this invention is not limited to the disclosed embodiment but is intended to cover various arrangements included within the spirit and scope of the broadest interpretation so as to encompass all such modifications and equivalent arrangements.

What is claimed is:

1. A hinge device comprising:

a coupler including two substantially C-shaped outer clamp members which are interconnected back-to-back at a juncture and which respectively have open mouths opposite to said juncture; and two substantially cylindrical inner clamp members fitted rotatably and respectively in said outer clamp members, each of said inner clamp members having a substantially cylindrical outer surface, and two clamping arms defining an axially extending clamping groove therebetween, said clamping groove having a groove opening alignable with said open mouth of one of said outer clamp members, wherein each of said inner clamp members has two axially opposite flanges protruding circumferentially and outwardly from said outer surface, each of said outer clamp members contacting said outer surface and being retained between said flanges.

2. The hinge device of claim 1, wherein said outer clamp members of said coupler are formed integrally as one piece.

3. A hinge device comprising:

a coupler including two substantially C-shaped outer clamp members which are interconnected back-to-back at a juncture and which respectively have open mouths opposite to said juncture; and two substantially cylindrical inner clamp members fitted rotatably and respectively in said outer clamp members, each of said inner clamp members having a substantially cylindrical outer surface, and two clamping arms defining an axially extending clamping groove therebetween, said clamping groove having a groove opening alignable with said open mouth of one of said outer clamp members, wherein said clamping groove of each of said inner clamp members has two diametrically opposite groove end sections, and a middle groove section between said groove end sections, one of said groove end sections being adjacent to said groove opening, said clamping groove having a width that decreases gradually from said groove end sections to said middle groove section.

4. A hinge device comprising:

a coupler including two substantially C-shaped outer clamp members which are interconnected back-to-back at a juncture and which respectively have open mouths opposite to said juncture; and two substantially cylindrical inner clamp members fitted rotatably and respectively in said outer clamp members, each of said inner clamp members having a substantially cylindrical outer surface, and two clamping aims defining an axially extending clamping groove therebetween, said clamping groove having a groove opening alignable with said open mouth of one of said outer clamp members, wherein each of said inner clamp members further has a connection web opposite to said groove opening and connected between said clamping arms, and wherein each of said clamping arms has an outer wall extending from said connection web to said groove opening along said outer surface, a compressible inner wall bounding said clamping groove, and a hollow space between said outer and inner walls, said inner wall having two ends one of which is connected to said outer wall adjacent said connection web and the other one of which is connected to said outer wall adjacent said groove opening.

5. The hinge device of claim 4, wherein said inner wall is convexed toward said clamping groove.

6. A hoop assembly comprising:

at least two hoops each having a noncircular cross section that is substantially flat, each of said hoops further having an annular inner rim, an annular outer rim surrounding said inner rim, and an annular intermediate section connected between said inner and outer rims, said inner and outer rims being thicker than said intermediate section; and a hinge device which includes a coupler and two substantially cylindrical inner clamp members;

said coupler having two substantially C-shaped outer clamp members which are interconnected back-to-back at a juncture and which respectively have open mouths opposite to said juncture;

said inner clamp members being fitted rotatably and respectively in said outer clamp members, each of said inner clamp members having a substantially cylindrical outer surface, and two clamping arms defining an axially extending clamping groove therebetween, said clamping groove having a groove opening alignable with said open mouth of one of said outer clamp members;

said inner clamp members respectively clamping said hoops by receiving said hoops in said clamping grooves.

* * * * *